United States Patent [19]

Shimoda et al.

[11] Patent Number: 4,699,587

[45] Date of Patent: Oct. 13, 1987

[54] BURNER

[75] Inventors: Hiromi Shimoda, Hasuda; Hajime Saito, Tokyo, both of Japan

[73] Assignee: Ishikawajima-Harima Jukogyo Kabushiki Kaisha, Tokyo, Japan

[21] Appl. No.: 863,036

[22] Filed: May 14, 1986

[30] Foreign Application Priority Data

May 23, 1985 [JP] Japan ..... 60-76716[U]
Jul. 23, 1985 [JP] Japan ..... 60-112829[U]
Aug. 14, 1985 [JP] Japan ..... 60-124827[U]

[51] Int. Cl.[4] ..... F23D 14/62

[52] U.S. Cl. ..... 431/354; 239/427; 239/433

[58] Field of Search ..... 431/354; 239/427, 427.3, 239/433

[56] References Cited

U.S. PATENT DOCUMENTS

| | | | |
|---|---|---|---|
| 3,446,439 | 5/1969 | Campbell | 239/433 X |
| 4,002,297 | 1/1977 | Pillard | 239/433 X |
| 4,160,526 | 7/1979 | Flanagan | 239/427 |
| 4,337,898 | 7/1982 | Cleall | 239/433 X |
| 4,485,968 | 12/1984 | Berthiaume | 239/427 X |
| 4,516,728 | 5/1985 | Whinfrey | 239/433 X |
| 4,601,428 | 7/1986 | Kurogo | 239/427.3 |
| 4,614,490 | 9/1986 | Kiczek et al. | 431/354 X |

FOREIGN PATENT DOCUMENTS

| | | | |
|---|---|---|---|
| 0065814 | 5/1980 | Japan | 239/427 |
| 58-77218 | 5/1983 | Japan . | |
| 60-114614 | 6/1985 | Japan . | |
| 60-117015 | 6/1985 | Japan . | |

*Primary Examiner*—Margaret A. Focarino

[57] ABSTRACT

A fuel supplied through a fuel feed bore of a burner plug and a spray medium supplied through spray medium feed holes thereof are mixed initially in primary mixing chambers in a burner plate and further mixed in a secondary mixing chamber in a burner tip and the fuel mixture thus obtained is sprayed through spray holes of the burner tip. Each of the primary mixing chambers is inclined at a predetermined angle relative to the axis of the burner plate so that the fuel mixture is caused to swirl in a secondary mixing chamber; or the burner plate and the burner tip are so interconnected to each other that the extension of the axis of each primary mixing chamber in the burner plate intersects substantially the midpoint between the adjacent spray holes of the burner tip and consequently the fuel mixture discharged from the primary mixing chambers impinges on the inner wall of the secondary mixing chamber in the burner tip, whereby the ability to atomize a slurry fuel is improved. Furthermore, thin ceramic layers are disposed at portions of the burner which are subjected excessive wear while the portions of the burner which are subjected to heavy thermal loads are made of a hard alloy so as to support the thin ceramic layers, whereby resistance to wear and safety of the burner are enhanced.

1 Claim, 9 Drawing Figures

BURNER

BACKGROUND OF THE INVENTION

The present invention relates to a burner adapted to burn a solid/liquid mixed fuel (a slurry/fuel) such as a coal/water mixed slurry (CWM), coal/oil mixed slurry (COM), coal/methanol mixed slurry (CMM) or the like or a liquid fuel, and more particularly a burner which is compact in size and capable of atomizing a fuel and withstanding wear.

Coal slurry fuels are atomized and sprayed by a burner. Conventionally, as shown in FIGS. 1 and 2, such burner k comprises a burner plug attached to the leading end of a fuel supply cylinder a and having a slurry feed bore b and a plurality of spray medium feed bores c disposed circumferentially of the slurry feed bore b. Attached to the leading end of the burner plug d is a burner plate g having first mixing chambers f in which the slurry from a slurry feed chamber e and the spray medium from the spray medium feed bores c are initially mixed. Attached to the leading end of the burner plate g is a burner tip j having a secondary mixing chamber h in which the fuel mixture from the first mixing chambers f is secondarily mixed and having spray holes i.

The slurry fuel supplied through the fuel feed cylinder a is fed through the slurry feed bore b in the burner plug d, the slurry feed chamber e in the burner plate g and a plurality of radially outwardly extending feed holes l into the circumferentially disposed primary mixing chambers f and then initially mixed with the spray medium such as the steam or air supplied through fine holes m from the spray medium feed bores c. The fuel mixture is then forced to directly flow from the primary mixing chambers f into the secondary mixing chamber h and is secondarily mixed and the atomized slurry fuel is sprayed through the spray holes i of the burner tip j.

How the slurry fuel is sprayed is dependent upon the fact how the slurry fuel is mixed with the spray medium in the primary and secondary mixing chambers f and h and is specially dependent upon how the fuel slurry and the spray medium are mixed in the secondary mixing chamber h in which the slurry fuel and the spray medium mixed in the primary mixing chambers f are further mixed.

With the burner of the type described above, the primary fuel mixture (that is, the slurry fuel and the spray medium mixed in the primary mixing chambers f) is forced to directly flow into the secondary mixing chamber h under the expectation that the primary fuel mixture does impinge and reflect upon the inner wall n of the secondary mixing chamber h so that a high degree of secondary mixing effect may be attained. However, in practice, part of the primary fuel mixture is not satisfactorily mixed in the secondary mixing chamber h and discharged through the spray holes i.

In addition, in the conventional burner of the type described above, the burner plate g and the burner tip j merely abut against each other so that the primary mixing chambers f are nonuniformly misaligned from the spray holes i as shown in FIG. 2. As a result, the fuel mixture discharged out of the primary mixing chambers f cannot uniformly flow into the adjacent spray holes i. Furthermore, the ratio of the fuel mixture which is discharged through the spray holes i without impinging upon the inner wall n and then reflecting therefrom is increased so that a satisfactory degree of mixing effect cannot be obtained in almost all the cases.

Moreover, in the case of a burner of the type for spraying a highly abrasive slurry fuel such as CWM, it has been proposed to use a high abrasion-resistance ceramic material such as $Si_3N_4$, SiC or the like to fabricate the parts including the spray holes i which are subjected to wear.

However, in this case, the ceramic materials have a low degree of resistance to thermal shock so that there arises a problem that the ceramic parts are cracked. Furthermore, the ceramic parts are cracked because of the difference in thermal deformation between the ceramic parts on the one hand and the burner tip j and the burner plate g which support such ceramic parts on the other hand.

SUMMARY OF THE INVENTION

In view of the above, the present invention has for its object to overcome the above and other problems encountered in the conventional burners and provides a burner in which a fuel from a slurry feed bore of a burner plug and a spray medium from spray medium feed bores are initially mixed in primary mixing chambers in a burner plate and then the primary fuel mixture thus obtained is further mixed in secondary mixing chamber in a burner tip and sprayed through spray holes, whereby the capability of the burner in atomizing the fuel can be improved.

In order to improve the fuel atomizing capability, the primary mixing chamber is inclined at a predetermined angle relative to the axis of the burner plate. Alternatively, the burner plate and the burner tip are so interconnected to each other that the extension of the axis of each primary mixing chamber in the burner plate intersects substantially at the midpoint between the adjacent spray holes of the burner tip.

When the primary mixing chambers are inclined at a predetermined angle relative to the axis of the burner plate, the primary fuel mixture is caused to swirl in the secondary mixing chamber so that secondary mixing is much facilitated. Furthermore, the primary fuel mixture is prevented from directly flowing toward the spray holes so that the unsatisfactory secondary fuel mixture can be prevented from being sprayed through the spray holes.

When the extension of the axis of each primary mixing chamber intersects substantially at midpoint between the adjacent spray holes, the primary fuel mixture from the primary mixing chambers in the burner plate is caused to impinge on the inner wall of the secondary mixing chamber substantially at the midpoint between the adjacent spray holes of the burner tip and reflects therefrom so that the fuel mixture can be uniformly distributed and sprayed through the adjacent spray holes.

In order to increase the resistance to wear and abrasion of the burner for burning a slurry fuel, a thin ceramic part is used at a portion which is subjected to excessive wear. Furthermore, a hard alloy steel is used at a portion which is subjected to a high thermal load, so as to support the ceramic parts.

Since the ceramic parts are used at the portions subjected to excessive wear and abrasion, the life of the burner for burning a slurry fuel is increased. Since the ceramic parts are made thin in thickness, the resistance to thermal shock can be improved. In addition, since the hard alloy steel is used at the portions subjected to high thermal loads, the stresses produced due to the difference in thermal deformation between the ceramic parts on the one hand and the other parts on the other hand can be minimized so that the safety of the ceramic parts can be ensured.

The above and other objects, effects, features and advantages of the present invention will become more apparent from the following description of some preferred embodiments thereof taken in conjunction with the accompanying drawing.

DETAILED DESCRIPTION OF THE PREFERRED EMBODIMENTS

Figure 1:
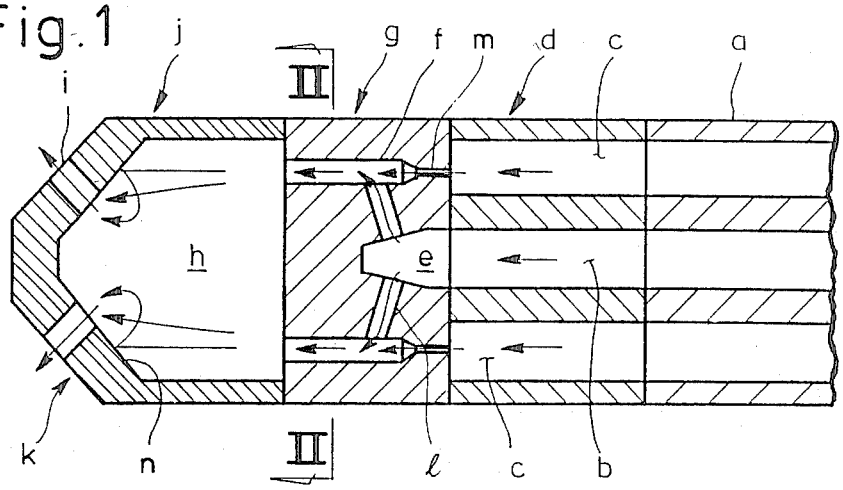
PRIOR ART Fig. 1
FIG. 1 is a view used to explain a conventional burner.
Figure 2:
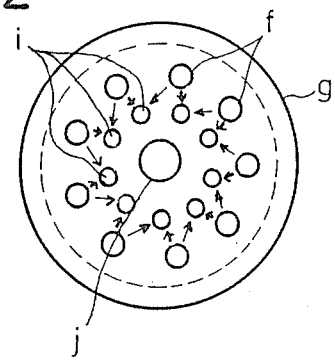
Fig. 2 PRIOR ART
FIG. 2 is a sectional view taken along the line II—II of FIG. 1.
Figure 3:
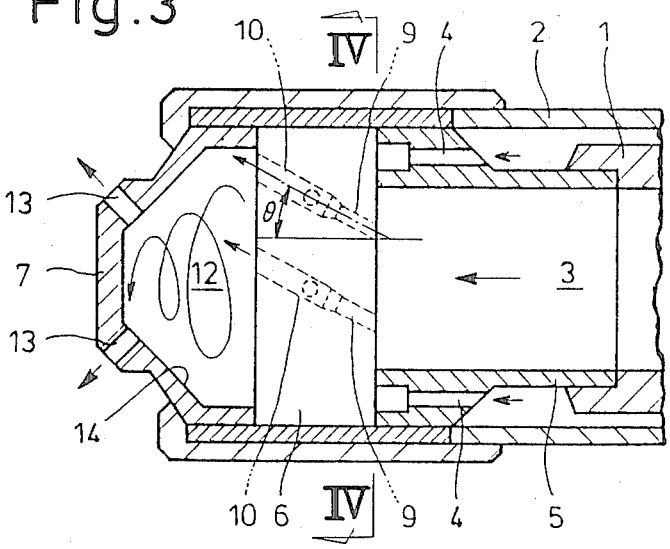
FIG. 3 is a view used to explain a first embodiment of a burner in accordance with the present invention.
Figure 4:
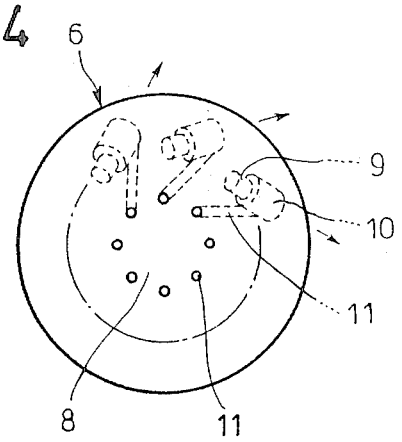
FIG. 4 is a sectional view taken along the line IV—IV of FIG. 3.

FIGS. 3 and 4 show a first embodiment of the present invention. Fitted over an outer atomizer barrel 2 having therein an inner atomizer barrel 1 for feeding a fuel is a burner plug 5 which has a coaxial slurry feed bore 3 and a plurality of spray medium feed bores 4 disposed circumferentially of the slurry feed bore 3. The burner plug 5 is connected to a burner tip 7 through a burner plate 6 which has a slurry introduction chamber 8 which in turn is coaxial with the burner plate 6 and is communicated with the slurry feed bore 3. Furthermore, a plurality of fine-diameter spray-medium introduction holes 9 are disposed circumferentially of the slurry introduction chamber 8 and are inclined at a predetermined angle $\theta$ relative to the axis of the burner plate 6. A portion of a predetermined length on the side of the burner tip 7 of each fine-diameter hole 9 is enlarged to define a primary mixing chamber 10 which is communicated with the slurry introduction chamber 8 through a fine-diameter hole 11 for introducing the slurry. The burner tip 7 has a secondary mixing chamber 12 and spray holes 13.

The spray medium supplied through the space defined between the outer and inner atomizer barrels 1 and 2 and the spray medium feed bores 4 in the burner plug 5 flows into the fine-diameter holes 9 and is mixed in the respective primary mixing chambers 10 with the slurry fuel supplied from the inner atomizer barrel 1 through the slurry feed bore 3 of the burner plug 5, the slurry introduction chamber 8 and the fine-diameter holes 11 in the burner plate 6. The primary fuel mixture thus obtained flows from the primary mixing chambers 10 into the secondary mixing chamber 12. The fine-diameter holes 9 and the primary mixing chambers 10 are inclined at a predetermined angle $\theta$ relative to the axis of the burner plate 6 so that the fuel mixture from the primary mixing chambers 10 are forced to swirl in the secondary mixing chamber 12, whereby mixing of the slurry fuel with the spray medium can be much facilitated.

Since the fuel mixture swirls in the secondary mixing chamber 12, a distance over which the fuel mixture travels from the discharge port of each primary mixing chamber 10 to the inner wall 14 of the burner tip 7 is increased so that the mixing action is further facilitated. The fuel mixture is swirled in the secondary mixing chamber 12 and then sprayed through the spray holes 13. As a result, the satisfactorily mixed fuel is discharged and the fuel mixture can be prevented from directly flowing toward and through the spray holes 13 of the burner tip 7.

The angle $\theta$ of inclination of each primary mixing chamber relative to the axis of the burner plate 6 can be determined suitably depending upon the capacity or the like of the burner. It should be noted that only the primary mixing chambers 10 must be inclined while the fine-diameter holes 9 may extend in parallel with the axis of the burner plate 6.

The first embodiment of the present invention has the following various effects, features and advantages:

(I) Since the primary mixing chambers are inclined by a predetermined angle $\theta$ relative to the axis of the burner plate, the primary fuel mixtures discharged out of the primary mixing chambers are forced to swirl in the secondary mixing chamber so that secondary mixing can be much facilitated.

(II) Since the primary fuel mixture is forced to swirl in the secondary mixing chamber, a distance over which the fuel mixture must travel or flow from the discharge port of each primary mixing chamber to the inner wall of the burner tip is increased so that secondary mixing is further facilitated.

(III) Since the primary mixture is forced to swirl in the secondary mixing chamber, it can be prevented from directly flowing from each primary mixing chamber toward the spray holes of the burner tip.

(IV) Because of (I), (II) and (III), the spray condition of the fuel can be remarkably improved.

Figure 5:
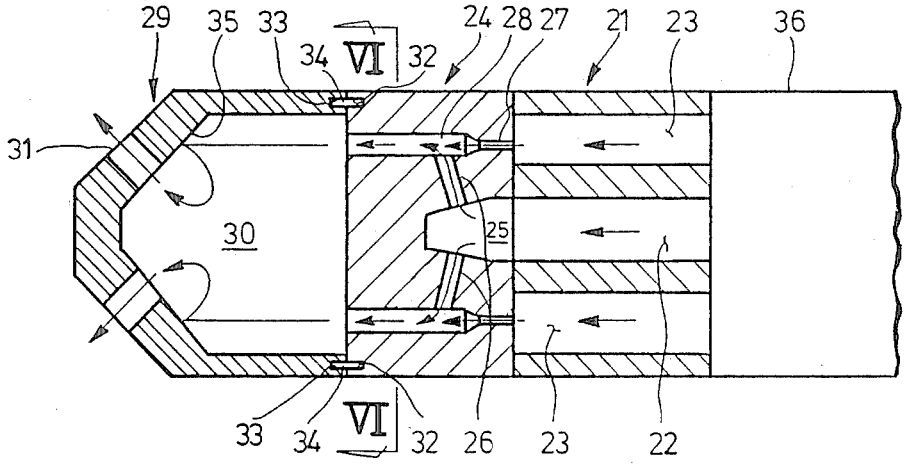
FIG. 5 is a view used to explain a second embodiment of the present invention.
Figure 6:
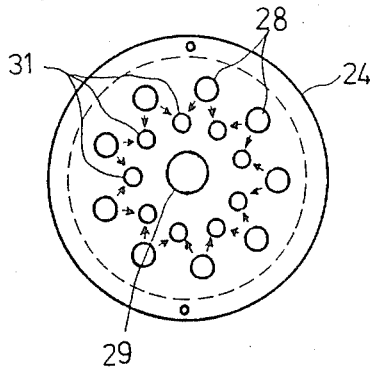
FIG. 6 is a sectional view taken along the line VI—VI of FIG. 5.

FIGS. 5 and 6 show a second embodiment of the present invention. Reference numeral 21 denotes a burner plug; 22, a slurry feed bore; 23, spray medium feed holes; 24, a burner plate; 25, a slurry introduction chamber; 26, fine-diameter holes for introducing the slurry; 27, fine-diameter holes for introducing the spray medium; 28, primary mixing chambers which are equiangularly spaced apart from each other and disposed along a circle; 29, a burner tip; 30, a secondary mixing chamber; and 31, equiangularly spaced apart spray holes which are disposed along a circle which is smaller in diameter than the circle along which are disposed the primary mixing chambers 28. The surfaces of contact between the burner plate 24 and the burner tip 29 are respectively formed with positioning holes 32 and 33 which are adjacent to the outer peripheries of the surfaces of the contact and are aligned with each other. Positioning pins 34 are fitted into the positioning holes 32 and 33 so that the burner plate 24 is correctly positioned relative to the burner tip 29. In this case, as shown in FIG. 6, the burner plate 24 and the burner tip 29 are so interconnected to each other that the extension of the axis of each primary mixing chamber 28 of the burner plate 24 substantially intersects the midpoint between the adjacent spray holes 31 on the inner wall 35 of the burner tip 29. Reference numeral 36 denotes a fuel supply cylinder or barrel.

In assemblying the burner, first the positioning pins 34 are inserted into the positioning holes 32 of the burner plate 24 and then inserted into the positioning holes 33 of the burner tip 29, whereby the burner plate 24 and the burner tip 29 are interconnected with each other correctly. Therefore, the burner plate 24 and the burner tip 29 can be quickly and readily assembled and their relative positions can be correctly maintained.

The primary fuel mixture which is obtained by mixing the coal slurry with the spray medium in each primary mixing chamber 28 in the burner plate 24 flows through the secondary mixing chamber 30 substantially straightly and impinges on the inner wall 35 almost at the midpoint between the adjacent spray holes 31 of the burner tip 29 and reflects back into the secondary mixing chamber 30. As a result, the fuel mixture is further uniformly mixed in the secondary mixing chamber 30 and is uniformly discharged through the spray holes 31 of the burner tip 29. Therefore, ideal secondary mixing can be accomplished in the secondary mixing chamber 30 and the coal slurry in the secondary fuel mixture discharged through the spray holes 31 is finely atomized so that the atomized coal slurry particles are burned in a very satisfactory manner.

In the second embodiment, it has been described that two positioning holes 32 and 33 and two positioning pins 34 are used; but it is to be understood that their number is not limited to two and may be one or more than two. As long as the burner plug 21 and the burner tip 29 are interconnected with each other correctly relative to each other, it may omit such positioning holes and pins as described above.

According to the second embodiment of the present invention, the burner plate 24 and the burner tip 27 are so interconnected to each other that the extension of the axis of each primary mixing chamber in the burner plate substantially intersects the midpoint between the adjacent spray holes of the burner tip. As a result, the primary fuel mixture impinges on the inner wall of the secondary mixing chamber and reflects back into the secondary mixing chamber to be mixed again. Thereafter the fuel mixture is sprayed through the spray holes uniformly. Thus the secondary mixing of the slurry fuel can be accomplished always under the ideal conditions.

Figure 7:
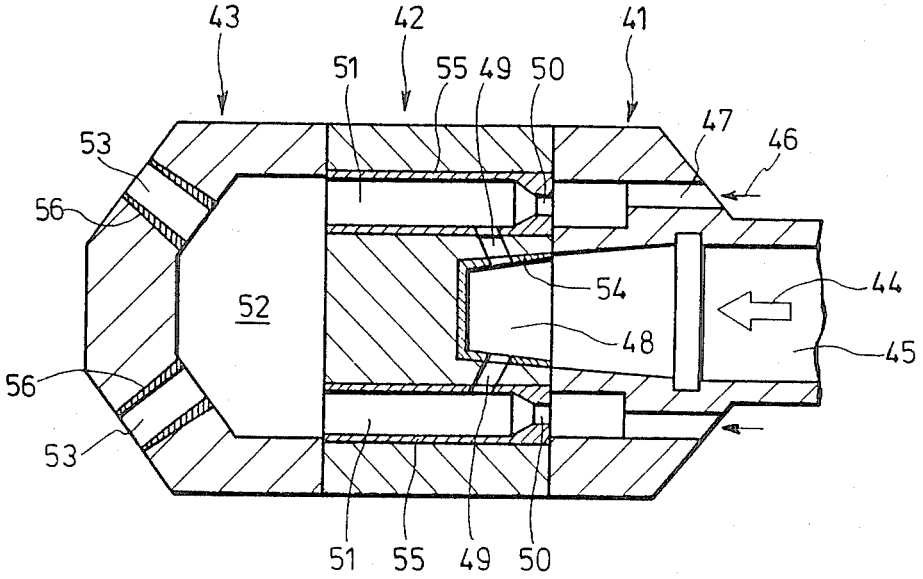
FIG. 7 is a view used to explain a third embodiment of the present invention.

FIG. 7 shows a third embodiment of the present invention comprising a burner plug 41, a burner plate 42 and a burner tip 43 which are interconnected with each other in the order named by means of a supporting member (not shown). Defined in the burner plug 41 are a slurry feed bore 45 through which flows a slurry fuel 44 and spray medium feed holes 47 through which flows a spray medium 46 such as the air or steam. Defined in the burner plate 42 are fine-diameter slurry feed holes 49 communicated with a slurry introduction chamber 48 which in turn is communicated with the slurry feed bore 45 and primary mixing chambers 51 each communicated through a fine-diameter spray medium feed hole 50 with the corresponding spray medium feed hole 47.

The burner tip 43 has a secondary mixing chamber 52 in communication with the primary mixing chambers 51 and spray holes 53 each intercommunicating the secondary mixing chamber 52 and the surrounding atmosphere.

The burner plug 41 and burner plate 42 subjected to less thermal loads are made of an alloy tool steel (for instance SKD61) and ceramic layers 54 and 55 one to three millimeters in thickness are bonded over the inner surfaces of the slurry introduction chamber 48 and the primary mixing chambers 51 in the burner plate 42 with a ceramic-series adhesive.

The burner tip 43 at the front of the burner which is subjected to a heavy thermal load is made of a hard alloy steel consisting of a double boride sintered alloy containing a Fe alloy containing Cr, Mo, Ni, Bo or the like. A tapered thin-wall ceramic layer 56 is securely bonded to the inner surface of each spray hole 53 with a ceramic series adhesive such that the ceramic layer 56 can be prevented from falling off the spray hole 53.

Even though the burner tip 43 is subjected to a heavy thermal load from the exterior, its resitance to thermal shock can be improved because the ceramic layers 56 are thin in thickness. In addition, the burner tip 43 itself is made of a hard alloy steel so that its thermal deformation is minimized. As a consequence, the stresses produced by the difference in thermal deformation between the ceramic layers 56 and the burner tip 43 can be minimized so that the safety of the ceramic layers 56 is ensured.

Even though the thin ceramic layers 54 and 55 are bonded to the inner surfaces of the slurry introduction chamber 48 and the primary mixing chambers 51 in the burner plate 42, the burner plate 42 itself is made of a general steel. The burner plate 42 is subjected to a less thermal load so that its thermal deformation is less and consequently the stresses produced by the difference in thermal deformation between the burner plate 42 and the ceramic layers 54 and 55 are negligible.

Figure 8:
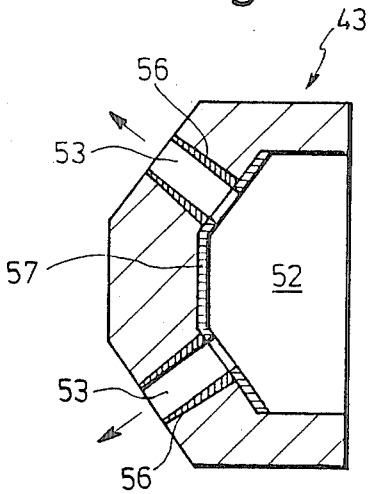
FIG. 8 is a view used to explain a modification of the burner tip shown in FIG. 7.
Figure 9:
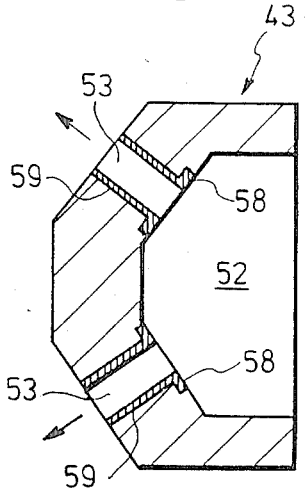
FIG. 9 is a view used to explain a further modification of the burner tip shown in FIG. 7.

FIGS. 8 and 9 show two modifications of the burner tip 43. In the modification as shown in FIG. 8, the tapered ceramic layer 56 is bonded to the inner surface of each spray hole 53 so as to prevent the wear thereof and a plate-like ceramic layer 57 is bonded to the front inner surface of the secondary mixing chamber 52 so as to prevent the wear thereof. In the modification as shown in FIG. 9, a straight ceramic layer or cylinder 59 with a flange 58 for preventing the falling off of the ceramic layer or cylinder 59 is inserted into each spray hole 53.

In the third embodiment, the shapes and positions of the ceramic layers or parts may be varied as needs demand and the portions which must be made of a hard alloy may be selected depending upon the thermal loads exerted thereto.

According to the third embodiment of the present invention, the ceramic parts are disposed so as to prevent wear so that the service life of the slurry-fuel-burning burner can be increased. In addition, the ceramic parts are made thin in thickness so that the resistance to thermal shock can be improved. Futhermore, the portions which are subjected to heavy thermal loads are made of a hard alloy so that the stresses produced by the difference in thermal deformation between the ceramic parts and the hard-alloy parts can be minimized. As a consequence, the safety of the ceramic parts can be ensure.

What is claimed is:

1. A burner comprising a burner plug, a fuel feed bore in said burner plug through which fuel can be supplied, a burner plate having one end thereof connected to said burner plug, spray-medium feed holes in said burner plug, primary mixing chambers in said burner plate in communication with said spray-medium feed holes for supplying a spray medium to said primary mixing chambers, means communicating said fuel feed bore with a said primary mixing chambers so that fuel can be mixed with spray medium in said primary mixing chambers, a burner tip connected to another end of said burner plate, a secondary mixing chamber in said burner tip in communication with said primary mixing chambers for further mixing the fuel with the spray medium, spray holes arranged in a wall of said secondary mixing chamber, and positioning means on said burner plate and burner tip to ensure that the burner plate and burner tip are connected such that extension of an axis of each primary mixing chamber in said burner plate intersects substantially midpoint between adjacent spray holes of said secondary mixing chamber.

* * * * *